US012698070B2

(12) United States Patent
Chen et al.

(10) Patent No.: US 12,698,070 B2
(45) Date of Patent: Aug. 4, 2026

(54) UNDERWATER HELICOPTER WITH CYCLOIDAL RIM VECTOR PROPULSION

(71) Applicants: Zhejiang University, Hangzhou City (CN); Ningbo Institute of Materials Technology & Engineering, CAS, Ningbo (CN)

(72) Inventors: Chen-Wei Chen, Hangzhou City (CN); Jialin Lu, Hangzhou City (CN); Wei Lu, Ningbo (CN); Tianjiang Zheng, Ningbo (CN); Min-Chiang Chao, Hangzhou City (CN)

(73) Assignees: Zhejiang University, Hangzhou City (CN); Ningbo Institute of Materials Technology & Engineering, CAS, Ningbo (CN)

( * ) Notice: Subject to any disclaimer, the term of this patent is extended or adjusted under 35 U.S.C. 154(b) by 289 days.

(21) Appl. No.: 18/592,510

(22) Filed: Feb. 29, 2024

(65) Prior Publication Data

US 2025/0115342 A1 Apr. 10, 2025

(30) Foreign Application Priority Data

Oct. 8, 2023 (CN) ..... 202311291813.6

(51) Int. Cl.
*B63G 8/18* (2006.01)
*B63G 8/08* (2006.01)

(52) U.S. Cl.
CPC *B63G 8/18* (2013.01); *B63G 8/08* (2013.01)

(58) Field of Classification Search
CPC ..... B63G 8/18; B63G 8/08
See application file for complete search history.

(56) References Cited

U.S. PATENT DOCUMENTS

| | | | | |
|---|---|---|---|---|
| 5,121,702 | A * | 6/1992 | Johnson | B63G 8/18 114/330 |
| 5,333,570 | A * | 8/1994 | DuBois | B63G 8/18 114/144 R |
| 5,653,404 | A * | 8/1997 | Ploshkin | B63G 8/08 244/73 C |
| 8,919,274 | B1 * | 12/2014 | Chen | B63G 8/16 114/330 |
| 2014/0061376 | A1 * | 3/2014 | Fisher | B63H 21/17 244/62 |
| 2021/0147052 | A1 * | 5/2021 | Lotz | B63G 8/08 |

FOREIGN PATENT DOCUMENTS

| | | | | |
|---|---|---|---|---|
| WO | WO-2016075631 A1 * | 5/2016 | ..... | B63H 23/326 |

* cited by examiner

*Primary Examiner* — Stephen P Avila
(74) *Attorney, Agent, or Firm* — Boulware & Valoir PLLC

(57) ABSTRACT

The present disclosure provides an underwater helicopter with cycloidal rim vector propulsion. The underwater helicopter includes a disc-shaped underwater helicopter hull, a rim driving mechanism, paddles and rotation adjusting mechanisms. The rim driving mechanism is annular, and the diameter size of the rim driving mechanism is matched with the circumference size of the disc-shaped underwater helicopter hull. The rim driving mechanism is fixedly installed in a cavity in the circumference of the disc-shaped underwater helicopter hull. The rotation adjusting mechanisms are uniformly and fixedly installed on the outer side of the rim driving mechanism. The paddle is fixedly connected with the rotation adjusting mechanism.

7 Claims, 3 Drawing Sheets

UNDERWATER HELICOPTER WITH CYCLOIDAL RIM VECTOR PROPULSION

CROSS-REFERENCE TO RELATED APPLICATION

This patent application claims the benefit and priority of Chinese Patent Application No. 202311291813.6, filed with the China National Intellectual Property Administration on Oct. 8, 2023, the disclosure of which is incorporated by reference herein in its entirety as part of the present application.

TECHNICAL FIELD

The present disclosure relates to the technical field of underwater propellers, in particular to an underwater helicopter with cycloidal rim vector propulsion.

BACKGROUND

In recent years, with the implementation of maritime power in China, underwater vehicles have gradually become the core issue of ocean exploration. As a novel underwater vehicle, the underwater helicopter developed by Zhejiang University has the outstanding characteristics such as spot hovering, full-circle steering and free take-off and landing. The underwater helicopter can preferably adapt to the marine environment. Compared with ordinary underwater vehicles, the underwater helicopter has better maneuverability and more working modes, and is an important carrier for underwater operation.

At present, the propulsion devices in the field of underwater vehicles are mainly shaftless rim propellers and cycloidal propellers. However, due to the structural and performance problems, the devices have not been popularized in the field of underwater vehicles. The main problems are as follows.

Firstly, the inner structure of the conduit of the shaftless rim propeller occupies part of circulation area, and the effective working area is small, so that it is difficult to greatly improve the efficiency of the whole system, and the performance of the underwater helicopter is affected.

Secondly, the device has the same problems as other propellers. The shaftless rim propellers and cycloidal propellers can only propel in a single direction, and cannot meet the needs of the underwater helicopters such as spot hovering, full-circle steering and free take-off and landing.

SUMMARY

The present disclosure aims to provide an underwater helicopter with cycloidal rim vector propulsion aiming at the disadvantages in the prior art. An underwater helicopter is taken as a carrier, and paddles are uniformly installed on the circumference of the underwater helicopter in combination with rim driving and cycloidal propellers.

In order to achieve the above purpose, the present disclosure adopts the following technical scheme.

An underwater helicopter with cycloidal rim vector propulsion includes a disc-shaped underwater helicopter hull, a rim driving mechanism, a plurality of paddles and a plurality of rotation adjusting mechanisms. The rim driving mechanism is annular, and the diameter size of the rim driving mechanism is matched with the circumference size of the disc-shaped underwater helicopter hull. The rim driving mechanism is fixedly installed in a cavity in the circumference of the disc-shaped underwater helicopter hull. The rotation adjusting mechanisms are uniformly and fixedly installed on the outer side of the rim driving mechanism. The paddle is connected with a support frame extending out of the rotation adjusting mechanism.

In the technical scheme, the disc-shaped underwater helicopter hull is used as a main body of a propeller, and the rim driving mechanism, the paddles and the rotation adjusting mechanisms jointly form the underwater helicopter with cycloidal rim vector propulsion to realize integrated design of the underwater helicopter and the propeller.

The paddles are annularly and uniformly arranged on the circumference of the disc-shaped underwater helicopter hull in central symmetry through a rotation adjusting mechanism. Each rotation adjusting mechanism is driven by the rim driving mechanism to be carried with the paddle to rotate directly around the axis of the disc-shaped underwater helicopter hull. At this time, propulsive force is annularly and uniformly distributed on the whole circumference of the underwater helicopter. The rotation adjusting mechanism can drive the paddle to rotate in a plane through the axis of the disc-shaped underwater helicopter hull (that is, in a longitudinal profile through the axis of the disc-shaped underwater helicopter hull) so as to adjust the direction of the propulsive force.

Further, the rim driving mechanism includes a motor control module, an inner stator, an outer rotor, water-lubricated bearings and an annular shell. The inner stator is encapsulated in an inner cavity of the annular shell through resin glue. A certain gap exists between the outer rotor and the inner stator. The outer rotor and the inner stator are limited by two pairs of water-lubricated bearings so that the outer rotor and the inner stator are centered. The outer rotor is fixedly connected with a rim and a box of the rotation adjusting mechanism, and can be regarded as integrated design. The motor control module is used for controlling the rim driving mechanism to be powered on and off and can be annularly placed at a lower end of the rim driving mechanism. The annular shell is fixedly connected with the cavity in the circumference of the disc-shaped underwater helicopter hull.

Further, the rotation adjusting mechanism includes a box, a motor, a main shaft, a main gear, an intermediate shaft, a first driven wheel, a secondary gear, a second driven wheel, a connecting shaft and a support frame, wherein the secondary gear and the second driven wheel are a pair of bevel gears. The motor is connected with the main shaft through a coupling. The main gear is fixed on the main shaft. The first driven wheel is meshed with the main gear. The secondary gear and the first driven wheel are fixed on the intermediate shaft. The secondary gear is meshed with the second driven wheel. The second driven wheel and the support frame are fixed on the connecting shaft. The paddle is fixedly connected with the support frame. The other end of the connecting shaft is installed on the box through a bearing. The second driven wheel drives the support frame and the paddle to rotate in a plane parallel to a rotating surface of the second driven wheel through the connecting shaft.

Further, the rotation adjusting mechanism drives the paddle to rotate by −90° to 90° in a plane through the axis of the disc-shaped underwater helicopter hull. When the angle rotates by 0°, that is, an axis of the paddle is vertical to the axis of the disc-shaped underwater helicopter hull, the paddle provides propulsive force in the vertical direction to realize the movement of the underwater helicopter in the vertical direction. When the angle rotates by 90° or −90°, that is, the axis of the paddle is parallel to the axis of the disc-shaped underwater helicopter hull, the paddle provides propulsive force in the horizontal direction to realize the movement of the underwater helicopter in the horizontal direction; and when the angle rotates in the range of −90° to 90°, the paddle can provide propulsive force in the direction required by the underwater helicopter.

Further, an electric control system controls the motor to realize the angular variation of the support frame and the paddles at an output end in the range of −90° to 90°.

Further, water inlet holes and water outlet holes are formed in the annular shell, and during the operation of the rim driving mechanism, water serves as a lubricant and a coolant in the gap between the outer rotor and the inner stator.

The present disclosure has the following beneficial effects.

Firstly, according to the underwater helicopter with cycloidal rim vector propulsion provided by the present disclosure, the underwater helicopter is different from a traditional propeller, and can only be installed at a specific position of an underwater vehicle as an independent part to realize a propulsion function. The underwater helicopter is innovatively taken as the main body of the propeller and forms the underwater helicopter with cycloidal rim vector propulsion together with the rim driving mechanism, the paddles and the rotation adjusting mechanisms, so that the integrated design of the underwater helicopter and the propeller is realized, the load of the underwater helicopter is greatly reduced, and the overall strength and rigidity are improved.

According to the underwater helicopter with cycloidal rim vector propulsion provided by the present disclosure, the rim driving mechanism, the paddles and the rotation adjusting mechanisms are uniformly and symmetrically arranged on the circumference of the disc-shaped underwater helicopter hull. By adopting a rim driving mode, the inner stator is fixed. The outer rotor drives the paddles to rotate directly around the axis of the underwater helicopter hull. On one hand, a transmission mechanism is simplified to transmit electromagnetic torque to the paddles to the maximum extent, and the ineffective energy consumption is reduced. On the other hand, due to the integrated design of the underwater helicopter and the propeller, the overall structure is in a centrosymmetric ring shape. When the outer rotor drives the paddles to rotate directly around the axis of the disc-shaped underwater helicopter, the propulsive force is annularly and uniformly distributed on the whole circumference of the underwater helicopter, so that the problem of uneven propulsive force caused by the intermittent independent deployment of traditional propellers is effectively avoided, and the stability of the underwater helicopter during operation is greatly improved.

Thirdly, according to the underwater helicopter with cycloidal rim vector propulsion, the underwater helicopter, a shaftless rim propeller and a cycloidal propeller are integrated into a whole body in a rim driving mode as a whole. Through the rotation adjusting mechanisms, the paddles rotate in the range of −90° to 90° in a plane through the axis of the disc-shaped underwater helicopter hull. Different from the manner that the traditional propeller can only provide single propulsive force, the present disclosure can provide propulsive force in the horizontal direction, the vertical direction and any direction in the range, so that the maneuverability of the underwater helicopter is thus greatly improved.

Fourthly, according to the underwater helicopter with cycloidal rim vector propulsion provided by the present disclosure, under the action of the rim driving mechanism and the rotation adjusting mechanism, the paddle movement mode is similar to that of the cycloidal propeller, the propulsion direction and size within the range of 360° can be quickly and continuously changed, the maneuverability is extremely high, high maneuvering actions such as lateral movement and in-situ rotation of the underwater helicopter are realized, and the performance requirements such as spot hovering and full-circle steering of the underwater helicopter are met.

Fifthly, according to the underwater helicopter with cycloidal rim vector propulsion provided by the present disclosure, the paddles are uniformly arranged around the circumference of the disc-shaped underwater helicopter hull. During the underwater helicopter movement, the structure can effectively overcome the problem that the underwater helicopter rotates around the axis of the underwater helicopter caused by the influence of ocean current or the difference of sizes or directions of the propulsive force output by the propeller. When rotating, the paddles and the underwater helicopter are in a state similar to the rotation of the propeller, the propulsive force in a direction the same as the movement direction is generated, the ability to break away from the ocean current is enhanced, and the overall power consumption is reduced, so that the underwater helicopter obtains better movement performance and longer endurance.

REFERENCE SIGNS

1, disc-shaped underwater helicopter hull; 2, cavity; 3, rim driving mechanism; 4, paddle; 5, support frame; 6, rotation adjusting mechanism; 7, annular shell; 8, water-lubricated bearing; 9, inner stator; 10, outer rotor; 11, rim; 12, water-lubricated bearing; 13, motor control module; 14, box; 15, motor; 16, main shaft; 17, main gear; 18, intermediate shaft; 19, first driven wheel; 20, secondary gear; 21, second driven wheel; 22, protection plate; and 23, connecting shaft.

DETAILED DESCRIPTION OF THE EMBODIMENTS

The present disclosure is described in detail in conjunction with the attached figures and the embodiments. It needs to be noted that the following embodiments are intended to explain the present disclosure, but not to limit the present disclosure. For the "inner side" and "outer side" in the present disclosure relative to the disc-shaped underwater helicopter hull, the position close to the disc-shaped underwater helicopter hull is called "inner side", and the position away from the disc-shaped underwater helicopter hull is called "outer side".

Figure 1:
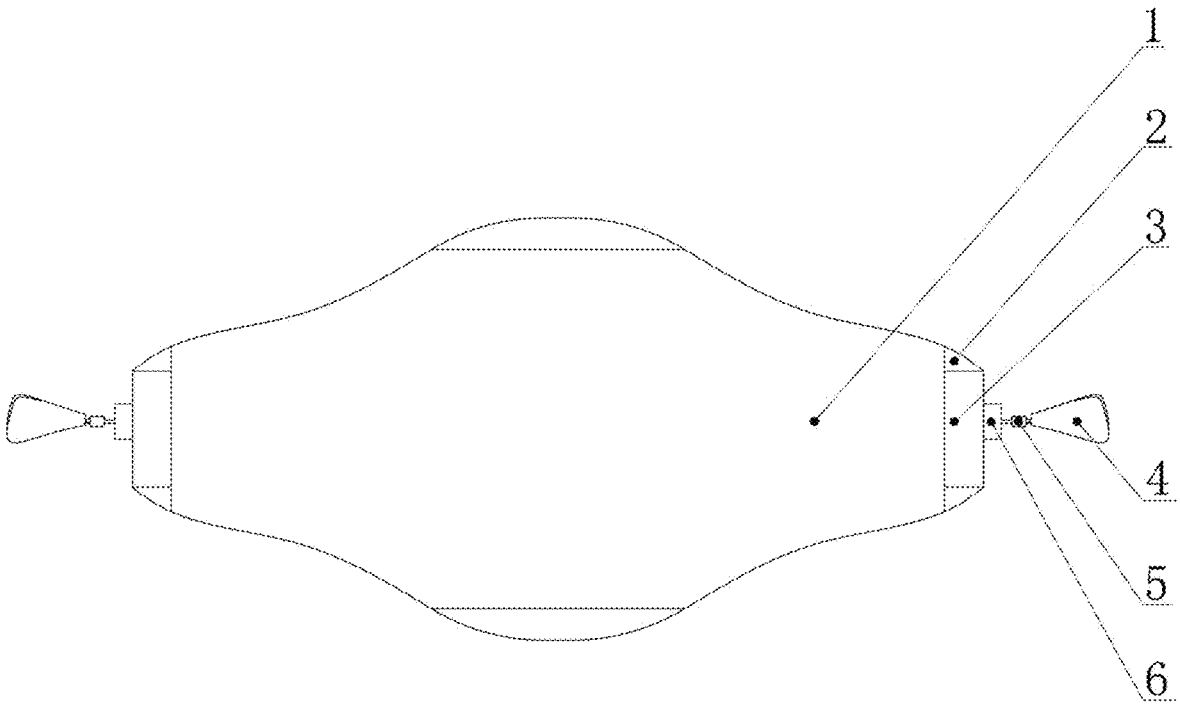
FIG. 1 is a structural schematic diagram of an underwater helicopter with cycloidal rim vector propulsion provided by the present disclosure.

As shown in FIG. 1, FIG. 1 is a specific example schematic diagram of an underwater helicopter with cycloidal rim vector propulsion in the present disclosure. The underwater helicopter includes a disc-shaped underwater helicopter hull 1, a rim driving mechanism 3, paddles 4 and rotation adjusting mechanisms 6. The rim driving mechanism 3 is annular, and the diameter size of the rim driving mechanism 3 is matched with the circumference size of the disc-shaped underwater helicopter hull 1 so that the rim driving mechanism 3 can be fixedly installed in a cavity 2 in the circumference of the disc-shaped underwater helicopter hull 1. The rotation adjusting mechanisms 6 are uniformly and fixedly installed on the outer side of the rim driving mechanism 3. The paddle 4 is connected with a support frame 5 extending out of the rotation adjusting mechanism 6.

Figure 2:
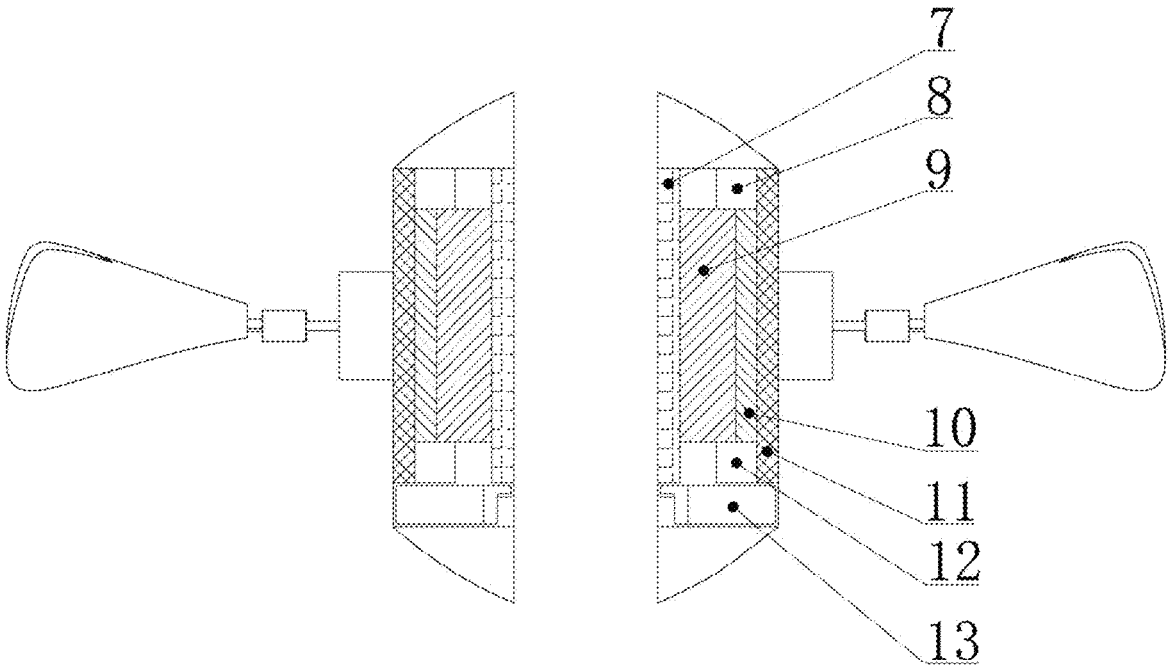
FIG. 2 is a structural schematic diagram of a rim driving mechanism provided by the present disclosure.

As shown in FIG. 2, the rim driving mechanism 3 includes a motor control module 3, an inner stator 9, an outer rotor 10, a rim 11, water-lubricated bearings 8 and 12 and an annular shell 7. The inner stator 9 is encapsulated in an inner cavity of the annular shell 7 through resin glue. A certain gap exists between the outer rotor 10 and the inner stator 9. The outer rotor 10 and the inner stator 9 are limited by two pairs of water-lubricated bearings 8 and 12 so that the outer rotor 10 and the inner stator 9 are centered. The outer rotor 10 is fixedly connected with a box 14 of the rotation adjusting mechanism 6, and can be regarded as integrated design. The motor control module 12 is placed at a lower end of the rim driving mechanism 3. The annular shell 7 is fixedly connected with the cavity 2 in the circumference of the disc-shaped underwater helicopter hull 1.

Figure 3:
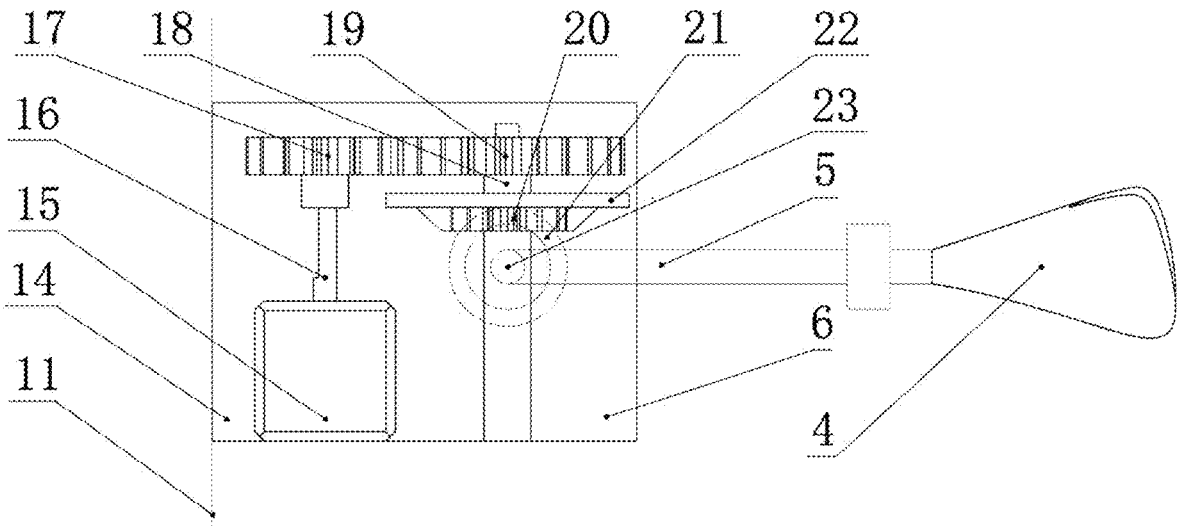
FIG. 3 is a structural schematic diagram of a rotation adjusting mechanism provided by the present disclosure.

The rotation adjusting mechanism 6, as shown in FIG. 3, includes a box 14, a motor 15, a main shaft 16, a main gear 17, an intermediate shaft 18, a first driven wheel 19, a secondary gear 20, a second driven wheel 21, a protection plate 22, a connecting shaft 23 and a support frame 5. The motor 15 is connected with the main shaft 16 through a coupling. The main gear 17 is fixed on the main shaft 16. The first driven wheel 19 is meshed with the main gear 17. The secondary gear 20 and the first driven wheel 19 are fixed on the intermediate shaft 18. The secondary gear 20 is meshed with the second driven wheel 21. The secondary gear 20 and the second driven wheel 21 are a pair of bevel gears. The second driven wheel 21 and the support frame 5 are fixed on the connecting shaft 23. The connecting shaft 23 is connected with the box through a bearing. One end of the support frame 5 extends out of the box and is fixedly connected with the paddle 4. In other specific examples of the present disclosure, the paddle 4 can rotate around an axis of the paddle 4 except that the paddle 4 can swing along with the support frame 5.

Figure 4A:
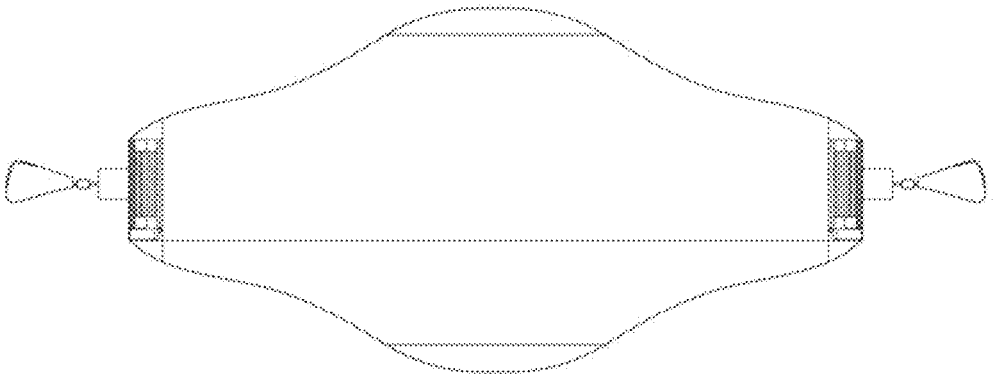
FIGS. 4A-B are working schematic diagrams of an underwater helicopter with cycloidal rim vector propulsion provided by the present disclosure.
Figure 4B:
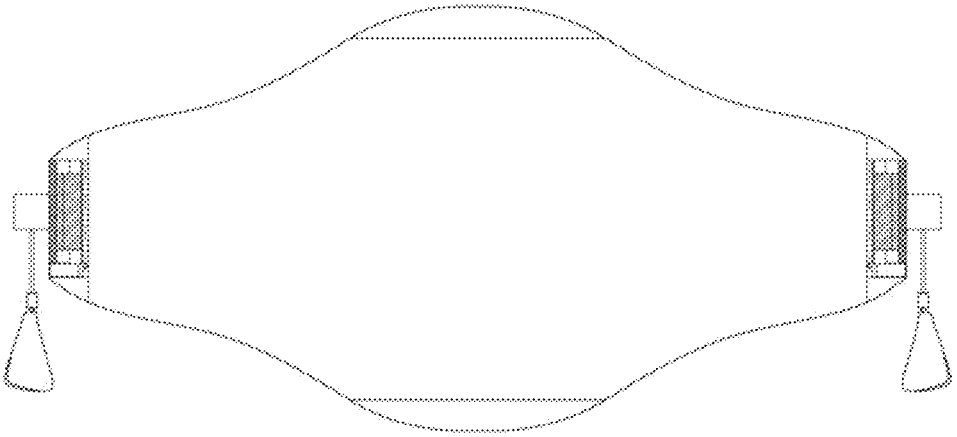
Figure 5:
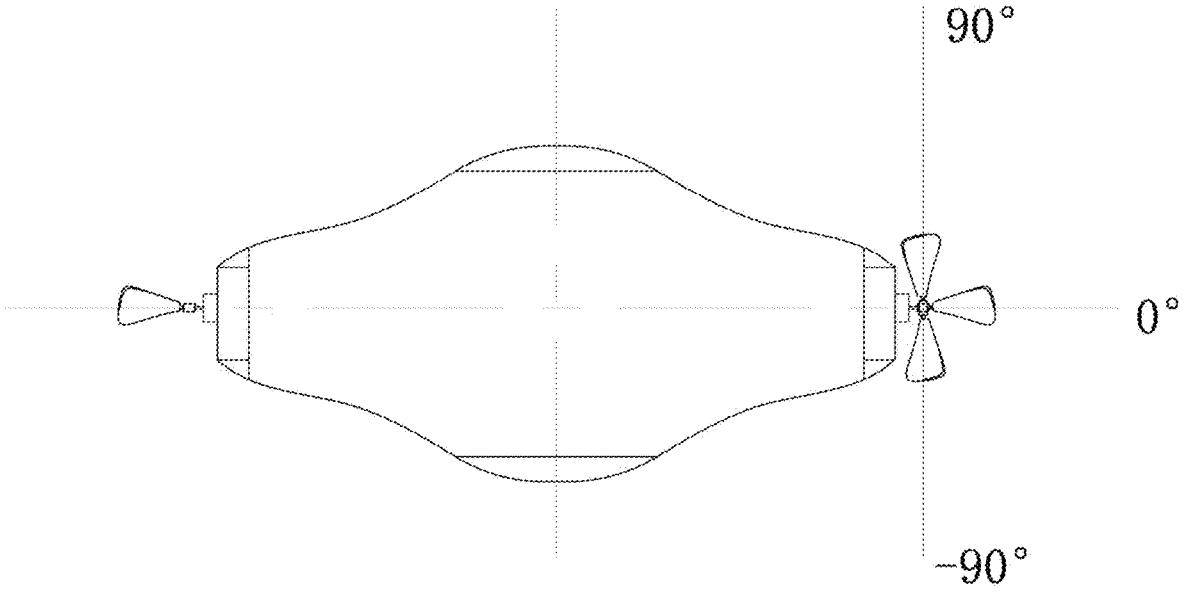
FIG. 5 is a rotation angle schematic diagram of a paddle in a rotation adjusting mechanism provided by the present disclosure.

In one specific embodiment of the present disclosure, the rotation adjusting mechanism 6 drives the paddle 4 to rotate by any angle of −90° to 90° in a plane through the axis of the disc-shaped underwater helicopter hull 1. When the angle rotates by 0°, that is, an axis of the paddle 4 is vertical to the axis of the disc-shaped underwater helicopter hull 1 (as shown in (a) of FIGS. 4A-B), the paddle 4 provides propulsive force in the vertical direction to realize the movement of the underwater helicopter in the vertical direction, so that free take-off and landing and spot hovering functions of the disc-shaped underwater helicopter hull are realized. When the angle rotates by 90° or −90°, that is, the axis of the paddle 4 is parallel to the axis of the disc-shaped underwater helicopter hull 1 (as shown in (b) of 4), the paddle 4 provides propulsive force in the horizontal direction to realize the movement of the underwater helicopter in the horizontal direction. When the angle rotates in the range of −90° to 90°, the paddle 4 can provide propulsive force in the direction required by the underwater helicopter to realize a full-circle steering function of the disc-shaped underwater helicopter hull. The angle relation of the paddle 4 driving rotation through the support frame is as shown in FIG. 5.

The rim driving mechanism 3 is powered on, the rotation adjusting mechanism 6 is off, and the outer rotor 10, together with the rotation adjusting mechanism 6, drives the paddle 4 to rotate to realize the movement of the underwater helicopter in the vertical direction. The rim driving mechanism 3 is powered on, the rotation adjusting mechanism 6 is powered on, and the motor 15 starts to work to drive the main gear 17 to be meshed with the first driven wheel 19 for multi-stage transmission to the connecting shaft 23 finally. The support frame 5 is driven to rotate by 90°. The paddle 4 is changed from a horizontal state to a vertical state. The outer rotor 10, together with the rotation adjusting mechanism 6, drives the paddle 4 to rotate, so that the movement of the underwater helicopter in the horizontal direction is realized.

In the foregoing specific implementations, the technical solutions, and benefits of the present disclosure are described in detail. It should be understood that the foregoing descriptions are merely specific implementations of the present disclosure, but are not intended to, limit the protection scope of the present disclosure. Any modification, equivalent replacement, or improvement made without departing from the spirit and principle of the present disclosure shall fall within the protection scope of the present disclosure.

The invention claimed is:

1. An underwater helicopter with cycloidal rim vector propulsion, comprising a disc-shaped underwater helicopter hull, a rim driving mechanism, a plurality of paddles and a plurality of rotation adjusting mechanisms, wherein the rim driving mechanism is annular, and the diameter size of the rim driving mechanism is matched with the circumference size of the disc-shaped underwater helicopter hull; the rim driving mechanism is fixedly installed in a cavity in the circumference of the disc-shaped underwater helicopter hull; the rotation adjusting mechanisms are uniformly and fixedly installed on the outer side of the rim driving mechanism; the paddle is fixedly connected with the rotation adjusting mechanism; the rim driving mechanism can drive the rotation adjusting mechanisms and the paddles to rotate along the circumferential direction; each rotation adjusting mechanism can drive the connected paddle to rotate in a longitudinal profile through an axis of the disc-shaped underwater helicopter hull; the disc-shaped underwater helicopter hull, as a main body of a propeller, is combined with the rim driving mechanism, the paddles and the rotation adjusting mechanisms to jointly form the underwater helicopter with cycloidal rim vector propulsion, so that the integrated design of the underwater helicopter and the propeller is realized.

2. The underwater helicopter with cycloidal rim vector propulsion according to claim 1, wherein the paddles are annularly arranged on the circumference of the disc-shaped underwater helicopter hull in central symmetry, and when the paddles directly rotate around the axis of the disc-shaped underwater helicopter hull, propulsive force is annularly and uniformly distributed on the whole circumference of the underwater helicopter.

3. The underwater helicopter with cycloidal rim vector propulsion according to claim 1, wherein the rim driving mechanism comprises a motor control module, an inner stator, an outer rotor, water-lubricated bearings and an annular shell, the inner stator is encapsulated in an inner cavity of the annular shell through resin glue, a certain gap exists between the outer rotor and the inner stator, the outer rotor and the inner stator are limited by two pairs of water-lubricated bearings so that the outer rotor and the inner stator are centered, the outer rotor is fixedly connected with the rotation adjusting mechanism, the motor control module is used for driving the outer rotor to rotate, and the annular shell is fixedly connected with the cavity in the circumference of the disc-shaped underwater helicopter hull.

4. The underwater helicopter with cycloidal rim vector propulsion according to claim 3, wherein water inlet holes and water outlet holes are formed in the annular shell, and during the operation of the rim driving mechanism, water serves as a lubricant and a coolant in the gap between the outer rotor and the inner stator.

5. The underwater helicopter with cycloidal rim vector propulsion according to claim 1, wherein the rotation adjusting mechanism comprises a box, a motor, a main shaft, a main gear, an intermediate shaft, a first driven wheel, a secondary gear, a second driven wheel, a connecting shaft and a support frame, the motor is fixed in the box and connected with the main shaft through a coupling, the main gear is fixed on the main shaft, the first driven wheel is meshed with the main gear, the secondary gear and the first driven wheel are fixed on the intermediate shaft, the secondary gear is meshed with the second driven wheel, the secondary gear and the second driven wheel are a pair of bevel gears, the second driven wheel and the support frame are fixed on the connecting shaft, one end of the connecting shaft is connected with the box through a bearing, one end of the support frame extends out of the box and is fixedly connected with the paddle, and the second driven wheel drives the support frame and the paddle to rotate in a plane parallel to a rotating surface of the second driven wheel through the connecting shaft.

6. The underwater helicopter with cycloidal rim vector propulsion according to claim 5, wherein an electric control system controls the motor to realize the angular variation of the support frame and the paddles at an output end in the range of −90° to 90° with a horizontal profile of the disc-shaped underwater helicopter hull.

7. The underwater helicopter with cycloidal rim vector propulsion according to claim 1, wherein the rotation adjusting mechanism drives the paddle to rotate by −90° to 90° in a plane through the axis of the disc-shaped underwater helicopter hull; when the angle rotates by 0° relative to the horizontal profile of the disc-shaped underwater helicopter hull, that is, an axis of the paddle is vertical to the axis of the disc-shaped underwater helicopter hull, the paddle provides propulsive force in the vertical direction to realize the movement of the underwater helicopter in the vertical direction; when the angle rotates by 90° or −90°, that is, the axis of the paddle is parallel to the axis of the disc-shaped underwater helicopter hull, the paddle provides propulsive force in the horizontal direction to realize the movement of the underwater helicopter in the horizontal direction; and when the angle rotates in the range of −90° to 90°, the paddle can provide propulsive force in the direction required by the underwater helicopter.

* * * * *